United States Patent [19]

Aidan

[11] Patent Number: 5,073,430

[45] Date of Patent: Dec. 17, 1991

[54] TRIM STRIP

[76] Inventor: S. Bruce Aidan, 17 Lickhill Rd., Stourport, Worcestershire, DY13 8SE,, England

[21] Appl. No.: 510,128

[22] Filed: Apr. 16, 1990

[30] Foreign Application Priority Data

Apr. 20, 1989 [BG] Bulgaria ..... 8909020

[51] Int. Cl.[5] ..... E04C 2/38; B32B 3/06

[52] U.S. Cl. ..... 428/43; 428/192; 52/179; 52/254; 52/255; 52/256; 52/287; 52/288

[58] Field of Search ..... 428/43, 192; 52/179, 52/287, 288, 254, 255, 256, 257

[56] References Cited

U.S. PATENT DOCUMENTS 2,843,889 7/1958 Keller ..... 52/287 X 3,421,274 1/1969 Balzer et al. ..... 52/179

*Primary Examiner*—Alexander S. Thomas

*Attorney, Agent, or Firm*—Renner, Kenner, Greive, Bobak, Taylor & Weber

[57] ABSTRACT

A tile edging trim strip comprises a body having an anchorage portion and an integral edge portion which projects from the anchorage portion and has an abutment part remote from the anchorage portion to abut against the edge of a tile, and a platform removably attached to the anchorage portion which projects towards the abutment part. The platform enables the trim strip to be adjusted for use with tiles of different thicknesses, and to allow for variations in section thickness of a tile. Thus, the platform may lift a thinner tile or tile edge off the anchorage portion into a position for abutting engagement of the abutment part with the tile, or the platform may be removed for a thicker tile or tile section to allow the tile to engage with the anchorage portion and still have abutting engagement with the abutment part. The platform may be formed integrally with, or be a separate element detachably connected to, the anchorage portion.

12 Claims, 3 Drawing Sheets

TRIM STRIP

This invention relates to a trim strip to be used as an edging for walls, floor and other surface, for example work-tops, coverings comprising ceramic tiles.

Such a trim strip is intended to provide a neat finish to the edging of the coverings. It is generally desirable for the strip to fit closely with the edges of the tiles with which it is used, to retain a substantially firm profile and be secure in use.

Trim strips are known which are mouldings or extrusions of plastics materials and comprise an edge portion which abuts against the edge of tiles with which the strips are used and is exposed in the fitted position, and an anchorage portion by which the strips are secured which lies behind or underneath the tiles and is hidden from view in use. Adhesive and/or screws, nails or similar fixings are used to secure the anchorage portion. Grouting material is usually applied between the tile edges and the edge portion.

Tiles can be of different thicknesses, and the thickness of a tile at a distance from its edge is greater than the thickness at the edge because of rounding from the front face to the edge of the tile. With these variations it has not always been easy to achieve a smooth finish between the tiles and known trim strips.

An aim of the present invention is to provide a trim strip which is readily fitted for use and presents a neat finish to the covering to which it is applied.

The present invention consists in a trim strip adapted for use as an edging for ceramic tile wall, floor or other surface coverings comprising a body having an anchorage portion and an integral edge portion which projects from the anchorage portion and has an abutment part remote from the anchorage portion adapted to abut against the edge of an adjacent tile when the trim strip is fitted for use, and a platform removably attached to the anchorage portion which projects towards the abutment part and serves in use of the trim strip to lift a tile or tile edge away from the anchorage portion for abutting engagement of the abutment part with the tile, the platform being removable to enable, alternatively, a thicker tile or tile section to be engaged with the anchorage portion and have abutting engagement with the abutment part.

Thus the removable platform enables the trim strip to be adjusted for different tile thicknesses.

The platform may be formed integrally with the anchorage portion and have a section adjacent to the anchorage portion at which it can be readily separated from the anchorage portion, for example by cutting or by manipulation of the platform to sever its connection to the anchorage portion. Alternatively the platform may be a separate element which is detachably connected to the anchorage portion. It may, for example, be a strip which releasably engages with a groove or key at the anchorage portion and projects from the anchorage portion.

Preferably the platform is of a different colour from the body to make it conspicuous on the anchorage portion.

The platform may also serve as a guide line for grout application over the anchorage portion.

Preferably at least the body of the trim strip is made as an extrusion. When the platform is a separate element it may be a strip which is co-extruded with the body and bonded at a surface to the anchorage portion by the co-extrusion process. Production of the trim strip by moulding may be possible although generally less convenient than by extrusion.

The edge portion may have a relatively thick section adjacent to the anchorage portion and reduce in thickness away from the anchorage portion, and it may have or define intermediate the anchorage portion and the abutment part a recess in which grouting material can be received. The relatively thick section adjacent to the anchorage portion gives the edge portion a degree of firmness which helps the portion to hold its form and to urge the abutment part into abutting engagement with the edge of an adjacent tile. However, the reduced thickness of the edge portion away from the anchorage portion gives the edge portion some flexibility adjacent to the abutment part which assists the abutment part in making good contact with the tile edge.

It is usual for the edges of tiles to be convexly rounded at the front surface. Preferably, therefore, the abutment part has a concavely curved surface which is able to make close area contact with such a rounded edge.

The trim strip may be adapted to serve as a trim at the outside of an angle between tiles covering surfaces which meet at a corner. For that purpose the edge portion may have a second abutment part adjacent to the anchorage portion for engagement with the edge of an adjacent tile extending at an angle relative to a tile with which the outer abutment part engages in use. As the surfaces to which the tiles are applied normally meet at right angles, the two abutment parts will, in general, present surfaces directed substantially at right angles to one another for contact with the tiles. The surface of the second abutment part may be concavely curved similarly to the surface of the outer abutment part, as mentioned above.

In another embodiment the trim strip may be adapted to be used for edging tiles on a surface which continues on beyond the tiles substantially parallel to the anchorage portion, for example on a wall where the tiles extend only part-way up the wall. A flexible fin may be provided on the edge portion to bear on the surface. The fin can lie close against the surface and so avoid gaps between the strip and the surface, particularly where there are irregularities on the surface. This not only benefits the finished appearance but can also assist in preventing condensation on the surface running down behind the tiles. Preferably the fin tapers to its free edge so that the edge has a substantial degree of flexibility.

For edging where there are existing tiles on a surface which extends beyond the tiles and new tiles are applied over the existing tiles, the anchorage portion of the trim strip may be sandwiched between the existing and new tiles with the abutment part of the edge portion abutting against the edges of the new tiles. The edge portion may have an extension, preferably substantially rigid, which is adapted to extend over the adjacent exposed edges of the existing tiles to the surface. A flexible fin may similarly be provided on the extension to bear on the surface. If new tiles are to be applied to the surface beyond the existing tiles the new tiles next to the existing tiles can abut against the extension of the trim strip and the flexible fin, if provided, can lie behind the abutting edges of those new tiles.

The edge portion may be shaped to present an outer surface of various forms to be exposed when the trim strip is fitted for use. In a preferred embodiment it presents an arcuate outer surface, more particularly a quadrantal outer surface.

The recess which the edge portion may have or define for the reception of grouting material enables the grouting material to key to the edge portion, which reduces the likelihood of gaps appearing and marring the appearance of the joint. In one embodiment the recess is a part-circular hollow which provides an undercut adjacent to the outer abutment part into which the grouting material can be received to enhance the keying of the material to the edge portion.

Preferably the face of the anchorage portion which is to lie against the surface to which the anchorage portion is to be secured for use has one or more grooves in it, conveniently of dovetail or other undercut form, to assist keying of adhesive to the anchorage portion for securing it in position. Openings may be formed at spaced positions in the anchorage portion for adhesive to engage in as well for keying purposes. Such grooves and openings may also assist in locking grout to the trim strip to prevent the applied grout from escaping, for example due to dimensional instability of the material of the strip.

Where the edge portion has an extension, as mentioned above, the extension may be grooved, ribbed, apertured or otherwise suitably formed to assist keying of adhesive and/or grout to it.

Apertures may be provided in the anchorage portion for screws, nails or like fixings. Alternatively fixings may be driven through the material of the anchorage portion as required in the course of fixing the anchorage portion for use. A reduced thickness part may be formed in the anchorage portion through which the fixings may be driven readily.

When the trim strip is intended to provide a trim at the outside of an angle between tiles or surfaces meeting at a corner, as previously mentioned, the trim strip may include some means at the anchorage portion to serve as a guide for positioning the trim strip relative to the corner for the second abutment part to engage with the respective tiles. The means may comprise, for example, a notch or notches in the anchorage portion, or a marker line or lines which may be of a different colour from the remainder of the strip. A marker line or lines of a different colour may be provided by embedding in or bonding on the anchorage portion plastics of a different colour to the body of the trim strip as the trim strip is formed.

Embodiments of the invention will now be described by way of example with reference to the accompanying drawings, in which.

In these embodiments the trim strip 1 is formed in each case as an extrusion, for example of a polyvinyl chloride.

Figure 1:
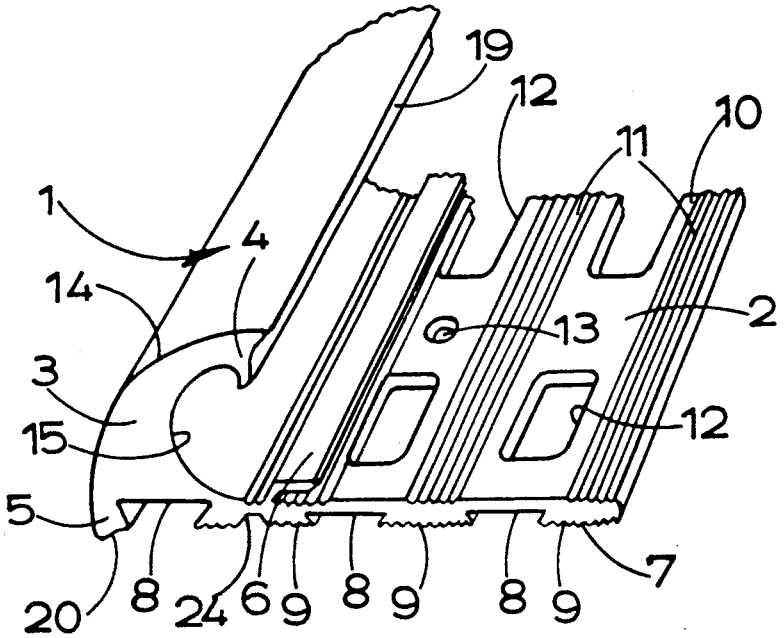
FIG. 1 is a fragmentary perspective view of a first embodiment of a trim strip in accordance with the present invention.
Figure 2:
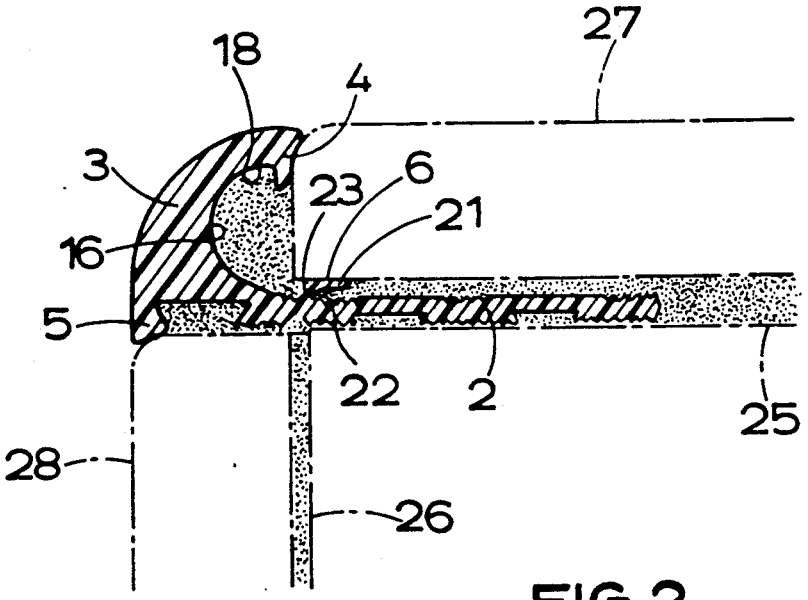
FIG. 2 is a transverse section through the trim strip.

Referring to the embodiment of FIGS. 1 and 2 of the drawings, the trim strip comprises a body 1 having an anchorage portion 2, an integral edge portion 3, a first abutment part 4 at an outer end of the edge portion 3 and a second abutment part 5 on the edge portion adjacent to the anchorage portion, and a removable platform 6 on the anchorage portion.

The anchorage portion 2 is generally plate-like in form increasing in thickness slightly across its width towards the edge portion which extends along one side of the anchorage portion. In an undersurface 7 of the anchorage portion, as viewed in the drawings, are three laterally spaced grooves 8 of dove-tail section which increase in depth towards the edge portion and are intended to assist in keying adhesive to the anchorage portion for securing the trim strip on a surface for use. Between the grooves 8 and beyond the groove nearest to the side edge of the anchorage portion remote from the edge portion the undersurface 7 is longitudinally ribbed 9 for keying purposes as well. An upper surface 10 of the anchorage portion also has longitudinal ribbing 11 to assist keying of grouting material to the anchorage portion. Openings 12 punched out of the anchorage portion assist keying of both adhesive and grouting material. Apertures 13 are provided at spaced intervals along the anchorage portion for fixing screws, nails or the like.

The edge portion 3 has a convex quadrantal front surface 14 and a deeply concaved rear surface 15 such that the edge portion has a rearwardly-curving crested wave form decreasing in thickness from its relatively broad root adjacent to the anchorage portion to its crest at the first abutment part 4, which overhangs the anchorage portion. A substantial recess 16 is defined by the concave rear of the edge portion. The abutment part 8 depends from the crest of the edge portion so that an undercut 18 is defined adjacent to the abutment part in the recess 16. The form of the edge portion with its relatively broad root gives the portion appreciable strength and rigidity whilst permitting some flexibility at the first abutment part 4.

The first abutment part 4 presents a rearwardly-facing concave surface 19, which may be ribbed longitudinally of the trim strip.

Second abutment part 5 is formed along the forward edge of the root of the edge portion and presents a downwardly-facing concave surface 20.

The removable platform 6 is integrally formed on top of the anchorage portion near to the root of the edge portion but rearwardly of the first abutment part 4. It is of a generally L-shape with its longer limb 21 spaced from and extending rearwardly parallel to the upper surface of the anchorage portion, and its shorter limb 22 extending downwards and joined by a thinned section 23 to the anchorage portion. If the platform is not needed when the trim strip is fitted for use it can be removed from the body 1 by tearing it away from the anchorage portion at the thinned section 23.

Opposite the platform 6 a marker groove 24 is formed in the undersurface 7 of the anchorage portion parallel to the second abutment part 5.

In FIG. 2 there is indication of how the trim strip is fitted at the corner of two tiled surfaces 25, 26 which meet at a right angle. Before the tiles are applied to the surfaces 25, 26 adjacent to the corner the anchorage portion is secured on the one surface 25 by adhesive and/or screws, nails or the like with the edge portion overhanging the corner. Alignment of the marker groove 24 with the corner positions the trim strip for the appropriate amount of the overhang of the edge portion. If uncut tiles are to be applied to extend to the corner on that surface 25 to which the anchorage portion is secured the platform 6 is left on the anchorage portion and that lifts the adjacent edges of the tiles 27 for the rounded front surface of the edges to engage with the concave surface 19 of the first abutment part, as shown. If cut tiles are to be applied, however, the platform is removed to allow for the thicker section of the tiles at the cut edges to engage with the concave surface of the first abutment part. The overhang of the edge portion from the corner allows for tiles 28 applied to the other surface 26 to engage satisfactorily with the concave surface 20 of the second abutment part 5.

Grouting material applied between the tiles 27, 28 and the trim strip is able to enter into the recess 16 and undercut 18, and also into the dove-tail groove 8 adjacent to the second abutment part 5, so as to key the material securely to the strip. This reduces the likelihood of unsightly gaps arising at the strip.

It will be understood that the trim strip is not only applicable to corners but may also be applied to a surface on an edging just for tiles applied to that surface. For that application the second abutment part would simply bear on the surface beyond the tiles.

Figure 3:
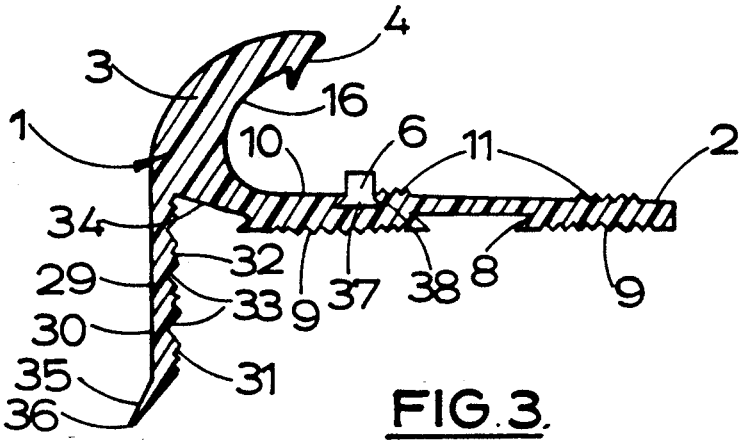
FIG. 3 is a transverse section through a second embodiment of a trim strip according to the invention.
Figure 4:
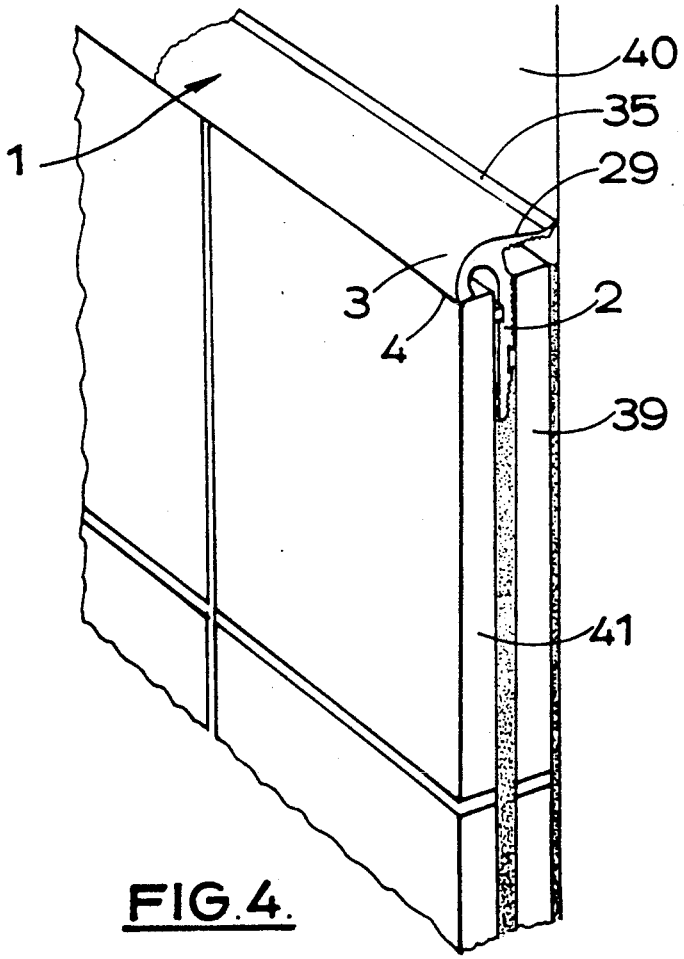
FIG. 4 is a perspective view showing the trim strip of FIG. 3 fitted for use to a wall

Referring now to FIGS. 3 and 4 of the accompanying drawings, the trim strip shown is adapted to be used where new tiles are applied over existing tiles on a surface which extends beyond the tiles. Parts of the trim strip similar to those of the first embodiment described above are identified by corresponding reference numerals. As before, the body 1 of the trim strip has an anchorage portion 2 and an integral edge portion 3 having an abutment part 4 at the outer end of the edge portion. A removable platform 6 is provided on the anchorage portion. The anchorage portion 2, edge portion 3 and abutment part 4 are all generally similar in form to their counterparts in the first embodiment. The concave rear of the edge portion defines a substantial recess 16. Whilst having longitudinal ribbing 9, 11 the anchorage portion 2 has only one dove-tail groove 8.

A substantially rigid extension 29 extends from the forward edge of the root of the edge portion 3 perpendicularly to the anchorage portion 2. It has a flat front surface 30 which is a tangential continuation of the quadrantal front surface 14 of the edge portion. A rear surface 31 of the extension has longitudinal ribbing 32 and spaced longitudinally extending V-section grooves 33. A dove-tail groove 34 is formed in the underside of the root of the edge portion adjacent to the extension 29. At the free end of the extension there is an integral flexible fin 35 which is forwardly inclined away from the extension and is sharply tapered to a free edge 36.

In this embodiment the removable platform 6 is provided by a separate strip of plastics material of generally rectangular cross-section with a dove-tail 37 by which the platform is detachably located in a complementary key-way 38 in the upper surface 10 of the anchorage portion. The platform projects from the anchorage portion for supporting thinner tiles, and is detachable if not required.

As shown in FIG. 4, the trim strip may be used as edging over the exposed ends of existing tiles 39 on a wall 40 and of new tiles 41 applied over the existing tiles. The anchorage portion 2 is sandwiched between, and secured by adhesive to, the existing and new tiles. The edge portion 3 overlies, and its abutment part 4 bears on, the exposed edges of the new tiles 41, and the extension 29 overlies the exposed edges of the existing tiles 39. The flexible fin 35 bears closely on the surface of the wall 40 adjacent to the existing tiles, and effectively seals the trim strip to the wall.

Grout can be received into the recess 16 of the edge portion over the new tiles, and also between the extension 29 and the existing tiles.

Figure 5:
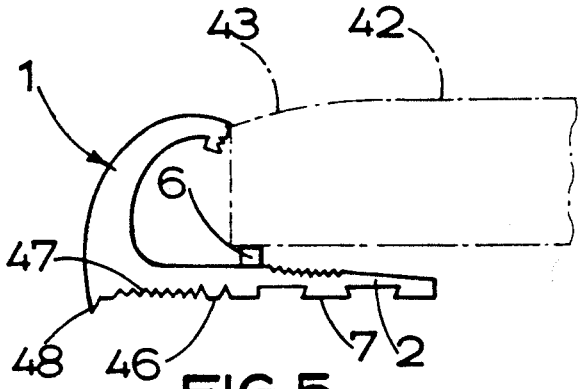
FIG. 5 is an end view of a third embodiment of a trim strip in accordance with the invention.
Figure 6:
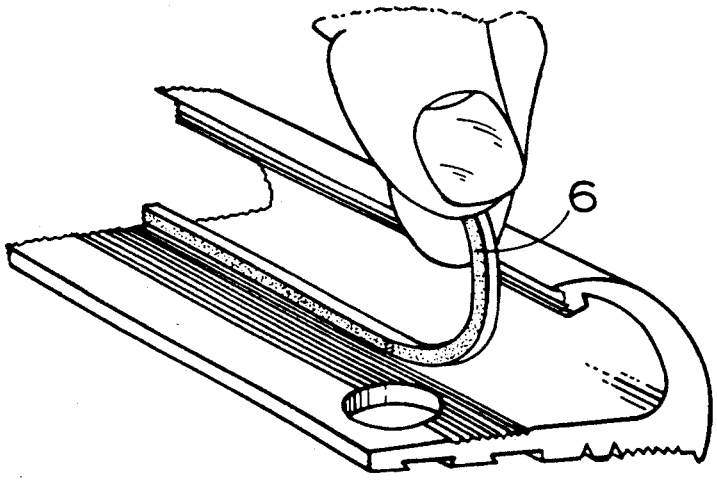
FIG. 6 is a perspective view of the trim strip of FIG. 5 showing a platform thereof being peeled away.
Figure 7:
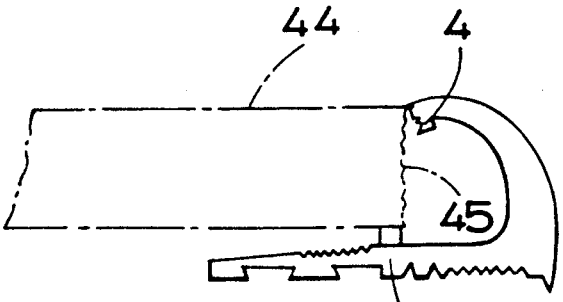
FIG. 7 is an end view of the trim strip after the platform has been removed and showing a tile in position on the trim strip.

The third embodiment illustrated by FIGS. 5 to 7 of the accompanying drawings, in which parts similar to those of the previous embodiments are again identified by corresponding reference numerals, also has its removable platform 6 provided by a separate strip of plastics material, and of rectangular cross-section. In this embodiment, however, the platform is co-extruded with the body 1 of the trim strip and by the process of co-extrusion is integrally bonded at one surface to the anchorage portion 2 of the trim strip. Conveniently the body 1 is extruded from a semi-rigid polyvinyl chloride and the platform 6 is extruded from a rigid polyvinyl chloride. Preferably the platform is of a bright colour, for example red, which makes it conspicuous on the anchorage portion 2. The platform 6 projects from the anchorage portion a distance which, as shown in FIG. 5, enables it to support a tile 42 such that a bevelled front edge 43 of the tile neatly nestles against the abutment part 4 of the edge portion 3 of the trim strip.

If it is not required, as when the trim strip is to be used with thicker or cut tiles, the platform can be peeled away from the anchorage portion, lifting from one end of the trim strip, as shown in FIG. 6. The bond between the platform and the anchorage portion can be released readily by pulling the platform away from the anchorage portion by hand. When the platform is removed a cut tile 44, for example, as shown in FIG. 7 can rest directly on the anchorage portion and the cut edge 45 at the front surface of the tile can nestle against the abutment part 4 of the edge portion of the trim strip.

A marker band 46 extending longitudinally along the undersurface 7 of the anchorage portion indicates an appropriate amount of overhang of the anchorage portion over a corner when the trim strip is fitted at a corner between surfaces to be tiled, as in FIG. 2. That marker band is formed by a thin co-extrusion of plastics material on the undersurface 7, preferably brightly coloured, like the platform, for conspicuousness.

A further modification present in the trim strip as shown in FIG. 5 to 7 is that the undersurface of the anchorage portion 2 adjacent to the edge portion 3 is horizontally ribbed, 47, instead of having a groove, for the keying of grout. A small depending lip 48 is formed along the front edge of the edge portion adjacent to the anchorage portion to engage over the adjacent edges of tiles overlapped by the undersurface of the anchorage and edge portions of the trim strips in use.

I claim:

1. A trim strip adapted for use as an edging for ceramic tile wall, floor or other surface coverings comprising a body having an anchorage portion and an integral edge portion which projects from said anchorage portion and has an abutment part remote from said anchorage portion adapted to abut against the edge of an adjacent tile when the trim strip is fitted for use, and a platform removably attached to said anchorage portion which projects towards said abutment part and serves in use of the trim strip to lift a tile or tile edge away from said anchorage portion for abutting engagement of said abutment part with the tile, said platform being removable to enable, alternatively, a thicker tile or tile section to be engaged with said anchorage portion and have abutting engagement with said abutment part.

2. A trim strip according to claim 1 wherein said platform is formed integrally with said anchorage portion and has a section adjacent to said anchorage portion at which it is separable from said anchorage portion.

3. A trim strip according to claim 1 wherein said platform is a separate element detachably connected to said anchorage portion.

4. A trim strip according to claim 3 wherein said anchorage portion has a groove therein and said platform is a strip releasably engaged with said groove.

5. A trim strip according to claim 3 wherein said body is an extrusion of plastics material and said platform is a plastics strip co-extruded with said body and bonded by the co-extrusion process to said anchorage portion.

6. A trim strip according to claim 1 wherein said edge portion has a relatively thick section adjacent to said anchorage portion and reduces in thickness away from said anchorage portion, and said edge portion defines a recess intermediate said anchorage portion and said abutment part in which grouting material can be received.

7. A trim strip according to claim 1 wherein said edge portion has a second abutment part adjacent to said anchorage portion for engagement with an edge of an adjacent tile in use.

8. A trim strip according to claim 1 wherein said edge portion has a flexible fin adapted for engagement in use of the trim strip with a surface extending substantially parallel to said anchorage portion.

9. A trim strip according to claim 1 wherein said edge portion has an extension adjacent to said anchorage portion projecting substantially at right angles to said anchorage portion away from said abutment part.

10. A trim strip according to claim 9 wherein said extension has an extremity at which is a flexible fin adapted for engagement in use of the trim strip with a surface extending substantially parallel to the anchorage portion.

11. A trim strip according to claim 1 wherein said anchorage portion has a surface remote from said abutment part and guide means is provided at said surface, said guide means extending parallel to said edge portion and serving as a guide for positioning the trip strip in use at the outside of an angle between tiles or surfaces meeting at a corner, such that a part of said anchorage portion adjacent to said edge portion can overlap an edge of an adjacent tile at the corner.

12. A trim strip according to claim 11 wherein said guide means comprises a marker line or lines extending along said surface of said anchorage portion and defined by plastics of a different colour applied to said anchorage portion as the body is formed.

* * * * *

UNITED STATES PATENT AND TRADEMARK OFFICE

CERTIFICATE OF CORRECTION

PATENT NO. : 5,073,430

DATED : December 17, 1991

INVENTOR(S) : Aidan Simon Bruce

It is certified that error appears in the above-identified patent and that said Letters Patent is hereby corrected as shown below:

Title page, item (75) inventors:

"S. Bruce Aidan" should read --Aidan Simon Bruce--.

Signed and Sealed this

Thirteenth Day of April, 1993

*Attest:*

STEPHEN G. KUNIN

*Attesting Officer*

*Acting Commissioner of Patents and Trademarks*